US010711529B2

(12) United States Patent
Rostvall

(10) Patent No.: US 10,711,529 B2
(45) Date of Patent: Jul. 14, 2020

(54) CUTTING TOOL

(71) Applicant: EPIROC DRILLING TOOLS AKTIEBOLAG, Fagersta (SE)

(72) Inventor: Tomas Rostvall, Stockholm (SE)

(73) Assignee: EPIROC DRILLING TOOLS AKTIEBOLAG, Fagersta (SE)

( * ) Notice: Subject to any disclaimer, the term of this patent is extended or adjusted under 35 U.S.C. 154(b) by 0 days.

(21) Appl. No.: 15/998,975

(22) PCT Filed: Feb. 15, 2017

(86) PCT No.: PCT/SE2017/050141

§ 371 (c)(1),
(2) Date: Aug. 17, 2018

(87) PCT Pub. No.: WO2017/142465

PCT Pub. Date: Aug. 24, 2017

(65) Prior Publication Data

US 2019/0292858 A1 Sep. 26, 2019

(30) Foreign Application Priority Data

Feb. 19, 2016 (SE) ..... 1650213

(51) Int. Cl.
*E21C 35/183* (2006.01)
*E21B 10/567* (2006.01)
(Continued)

(52) U.S. Cl.
CPC ..... *E21B 10/5673* (2013.01); *B28D 1/18* (2013.01); *E21B 10/633* (2013.01); *E21C 35/18* (2013.01);
(Continued)

(58) Field of Classification Search
CPC ..... E21C 35/18; E21C 2035/1803; E21C 2035/1806; E21C 2035/1816;
(Continued)

(56) References Cited

U.S. PATENT DOCUMENTS 4,981,328 A 1/1991 Stiffler et al.
5,141,289 A 8/1992 Stiffler
(Continued)

FOREIGN PATENT DOCUMENTS

CN 101842202 A 9/2010
CN 201857967 U * 6/2011
(Continued)

OTHER PUBLICATIONS

Written Opinion and International Search Report dated May 11, 2017 in corresponding International Application No. PCT/SE2017/060141 (6 pages).
(Continued)

*Primary Examiner* — Sunil Singh
(74) *Attorney, Agent, or Firm* — Venable LLP; Jeffri A. Kaminski

(57) ABSTRACT

A cutting tool is provided. The cutting tool comprising a tip, a body and a shank for attaching the cutting tool to a tool holder. The body has an outer body surface, a body shank end arranged towards the shank and a body tip end arranged towards the tip. The tip has an outer tip surface, a tip peak and a tip base, the tip base being attached to the body tip end of the body. The cutting tool comprises a plurality of grooves extending substantially continuously over both the outer tip surface and the outer body surface, each groove having a predetermined extension in a longitudinal direction of the cutting tool.

13 Claims, 6 Drawing Sheets

(51) Int. Cl.
*B28D 1/18* (2006.01)
*E21B 10/633* (2006.01)
*E21C 35/18* (2006.01)

(52) U.S. Cl.
CPC ..... *E21C 2035/1806* (2013.01); *E21C 2035/1816* (2013.01)

(58) Field of Classification Search
CPC ..... E21C 35/183; E21C 35/187; E21C 35/19; E21C 35/193; E21C 35/1933; E21C 35/1936; E21C 2035/191
USPC ..... 299/100–111, 112 T, 112 R, 113, 81.1, 299/81.2, 81.3
See application file for complete search history.

(56) References Cited

U.S. PATENT DOCUMENTS

| | | | | |
|---|---|---|---|---|
| 5,551,760 | A * | 9/1996 | Sollami | E21B 10/567 299/105 |
| 6,019,434 | A | 2/2000 | Emmerich | |
| 6,199,956 | B1 | 3/2001 | Kammerer | |
| 6,354,771 | B1 * | 3/2002 | Bauschulte | E21C 35/183 175/427 |
| 2008/0084106 | A1 | 4/2008 | Marathe et al. | |
| 2010/0295360 | A1 * | 11/2010 | Kramer | B28D 1/186 299/110 |
| 2011/0000717 | A1 | 1/2011 | Carlsson et al. | |
| 2012/0080931 | A1 * | 4/2012 | Wang | B28D 1/188 299/113 |
| 2012/0098326 | A1 | 4/2012 | Monyak et al. | |
| 2013/0327577 | A1 | 12/2013 | Macintyre et al. | |
| 2014/0191562 | A1 * | 7/2014 | Greenspan | E02F 9/2866 299/101 |
| 2014/0232172 | A1 | 8/2014 | Roth et al. | |

FOREIGN PATENT DOCUMENTS

| | | | |
|---|---|---|---|
| CN | 102121351 | A | 7/2011 |
| CN | 104564066 | A | 4/2015 |
| CN | 204511441 | U | 7/2015 |
| DE | 102007051911 | A1 | 5/2009 |
| EP | 0908601 | A1 | 4/1999 |
| GB | 1089611 | A | 11/1967 |
| RU | 2026985 | C1 | 1/1995 |
| RU | 2446283 | C2 | 3/2012 |
| SU | 823515 | A1 | 4/1981 |
| WO | 2010099512 | A1 | 9/2010 |
| WO | WO 2012054199 | A1 * | 4/2012 |
| WO | 2012075671 | A1 | 6/2012 |

OTHER PUBLICATIONS

Chinese Office Action with Search Report dated Mar. 20, 2019 in corresponding Chinese Application No. 201780011840.X (21 pages).
Extended European Search Report in corresponding European Application No. EP 17 75 3579.6 dated Sep. 23, 2019 (7 pages).
Chinese Office Action dated Sep. 25, 2019 in corresponding Chinese Application No. 201780011840.X (8 pages).
Russian Decision to Grant dated Apr. 24, 2020 in corresponding Russian Application No. 2018132560 (16 pages).

* cited by examiner

CUTTING TOOL

TECHNICAL FIELD

Embodiments herein relate to a cutting tool.

BACKGROUND

When a surface layer of a paved area is exposed to different temperatures, ageing and vehicles driving over the surface, it may become worn and uneven. For example, heavy vehicles which starts and stops in front of a traffic light, causes the surface layer to shear relatively lower layers. The surface layer can be milled off, and a material of the surface layer may in some cases be recycled and used as aggregate when a new surface layer is paved to replace the old one.

The process of removing the surface layer can be referred to as asphalt milling, profiling, cold planning or pavement milling. During such a process a milling machine or cold planner provided with a large rotating drum or planner equipped with cutting tools can be used. The drum or planner, when rotating, grinds and removes the surface layer of e.g. a road or a parking lot. The cutting/milling is also commonly performed on various kinds of concrete surfaces, such as at bus stops, bridges and runways.

Such a drum can comprise a plurality of tool holders or attachment portions for cutting tools. An example of such a cutting tool is disclosed in US20140232172A1. In US20140232172A1, the cutting tool comprises a body, a shank which can be attached to a drum, and a cutting element.

Cutting tools are also used in several other applications, such as during coal mining or mechanical processing of rocks etc. Cutting tools may also be used during rotary drilling, such as described in WO2010099512A1. Cutting tools may also be referred to as milling tools or milling bits.

A body of the type disclosed in US20140232172A1 can be made of metal and the cutting element can be made of a hard material. When a drum with a number of cutting tools attached to a periphery of the drum is rotated on a paved surface each cutting element on each cutting tool shears away material and hereby the surface layer of the paved surface is removed.

U.S. Pat. No. 6,199,956B1 discloses a shank bit for coal cutting etc. A bit head comprises a tip bit with recesses. The recesses may facilitate introduction of circumferential forces to the bit head. The cutting tool disclosed in U.S. Pat. No. 6,199,956B1 may be suitable in some applications but there remains a need for a cutting tool which can be used for a longer amount of time before it is worn out. There also remains a need for a cutting tool which decreases forces between a surface to be milled and a tool holder and also distributes the forces between the surface to be milled and the tool holder in an advantageous manner. Further, in some milling machines and cold planners cooling of the cutting tool is achieved through water sprayed on the cutting tool. However, it may be difficult to sufficiently cool the cutting tool or some parts thereof. Insufficient cooling may lead to excessive temperature and high wear of the cutting tool. Thus, a problem in this regard is both enabling of sufficient cooling of the cutting tool and that the wear properties and required cutting forces of prior art cutting tools are not sufficiently good.

SUMMARY

Embodiments herein aim to provide a cutting tool with better wear and cooling properties enabling lower required cutting forces, driving forces and fuel consumption than prior art cutting tools.

According to an embodiment, this is provided by a cutting tool comprising a tip, a body and a shank for attaching the cutting tool to a tool holder,

- the body having an outer body surface, a body shank end arranged towards the shank and a body tip end arranged towards the tip,
- the tip having an outer tip surface, a tip peak and a tip base, the tip base being attached to the body tip end of the body, wherein the cutting tool comprises a plurality of grooves extending substantially continuously over both the outer tip surface and the outer body surface, each groove having a predetermined extension in a longitudinal direction of the cutting tool.

Since the cutting tool comprises a plurality of grooves extending substantially continuously over both the outer tip surface and the outer body surface, each groove having a predetermined extension in a longitudinal direction of the cutting tool, the cutting tool has excellent wear properties. The grooves will enable the cutting tool to be evenly worn throughout its life cycle, i.e. from the cutting tool is new until it is worn out. During cutting, milling and other use of the cutting tool, material which is processed by the cutting tool will exert forces to the cutting tool via the grooves, whereby the cutting tool will rotate around its longitudinal axis. The extension of the grooves are predetermined, which has the effect that the extent of forces from a processing material, such as asphalt or concrete, are distributed to the cutting tool can be more precisely controlled. Hereby it is also ensured that the cutting tool is enabled to rotate in both directions, i.e. both clockwise and counter-clockwise around its longitudinal axis. This counteracts uneven and/or unsymmetrical wear of the body and/or the tip.

Since the grooves extend substantially continuously over both the outer body surface and the outer tip surface, efficient flow of the milled material is facilitated and not disturbed by the interface between the tip and body surface. This relatively easy flow of milled material along the grooves will lower forces and wear on the steel body and also to some extent on the tip. The risk of sticking of the milled material in the transition region between the body and the tip is decreased. The continuous grooves also allow cooling water to flow along the grooves towards the tip, such that the water may reach and efficiently cool the tip surface. In some milling machines and cold planners the cooling of the cutting tool is achieved through water sprayed on the cutting tool. However most of the water initially only reach the surface of the steel body, not the tip. With the continuous grooves according to embodiments herein more water is reaching the tip. Further a "cooling area", i.e. the outer surface of the tip which may transfer heat from the tip, is enlarged by the grooves. Hereby cooling of the tip is increased, resulting in decreased tip temperature and decreased wear of the cutting tool. The efficient flow lower the necessary cutting forces and lower the energy consumption of a machine to which the cutting tool is attached. In the prior art the flow of cooling water and milled material along the outer surface of the cutting tool is interrupted at the interface between the tip and body. Rotation of the tool is also improved by the smooth transition region between the body and the tip. This has been proven to decrease the wear and forces, thereby increasing the lifetime of the cutting tool. High wear may cause cracks and non-symmetrical wash-outs which may be exaggerated during use and will shorten the lifetime of the cutting tool.

Further, with the relatively long continuous grooves less hard metal alloy is needed for producing the tip. This makes the cutting tool cheaper to produce. The continuous grooves also facilitate breaking of the milled material and thus render the milling operation more efficient.

Thus, with a cutting tool according to embodiments herein even wear of the cutting tool is achieved. Evenly worn cutting tools provides both for reduced required cutting forces and lower energy consumption of a machine to which the cutting tool is attached.

According to some embodiments the tip base has a tip length in the longitudinal direction, and where a tip groove portion of the grooves extend on the outer tip surface over a major part of the tip base length. Hereby material which comes into contact with the tip will exert forces in a tangential direction of the tip, whereby the cutting tool is enabled to easily rotate. The groove portions on the tip will allow the cutting tool to be rotated at an early stage and/or when used for shallow milling, e.g. when only the tip is in contact with the material which is to be removed/processed. The wear properties are thus improved at an early stage in the life cycle of the cutting tool whereby the lifetime is increased.

According to some embodiments the body has a length in the longitudinal direction, and where a body groove portion of the grooves extends on the outer body surface over a major part of the body length. This provides for even wear until the cutting tool is almost worn out. In addition, with relatively long groove portions on the body the number, depth and/or width of the grooves may be relatively freely designed and/or dimensioned.

According to some embodiments the tip comprises a substantially cylindrically-shaped portion which extends in the longitudinal direction between the tip peak and the tip base, and that a length of the substantially cylindrically shaped portion exceeds 10 mm. The relatively slender tip will be worn down in a foreseeable and relatively controlled manner and keep the slender cutting geometry of the tool such that forces are limited and vibrations are avoided.

According to some embodiments the body has a radius which increases continuously along a smooth curve from the body tip end to the body shank end. This relatively smooth and slender configuration of the cutting tool may be referred to as a "skirt design" cutting tool. The body with the continuously increasing radius enables the cutting tool to be worn down in a foreseeable and relatively controlled manner. Hereby vibrations are kept low, noise is reduced and a good economy is achieved with low fuel consumption and long life-time of the cutting tool.

According to some embodiments the tip has a radius which increases continuously along a smooth curve from the cylindrically-shaped portion to a distal portion of the tip base. The continuously increasing radius of the tip enables the cutting tool to be worn down in a foreseeable and relatively controlled manner. Hereby vibrations are kept low, noise is reduced and a good economy is achieved with low fuel consumption and long life-time of the cutting tool.

According to some embodiments a depth of the tip groove portions is at least 0.5 mm. The depth is the maximum depth of the tip groove portion relatively the radius of the tip adjacent to the groove. The required minimum depth and width of the grooves may be dependent on or designed after milled materials properties and coarseness. In some embodiments the depth of the grooves is at least half of a width of the grooves in order to allow the milled material to pass into the grooves and exert tangential forces on the cutting tool. Hereby the exposed surface area which forms the tip groove portion will be sufficiently large for transferring tangential forces from material to be processed to the cutting tool. These tangential forces can cause the cutting tool to be rotated around its longitudinal axis during cutting/milling, whereby even wear is achieved.

According to some embodiments a depth of the body groove portions is at least 1 mm. The depth is the maximum depth relatively the radius of the body adjacent to the groove. The required minimum depth and width of the grooves may be dependent on or designed after milled materials properties and coarseness. In some embodiments the depth of the grooves is at least half of a width of the grooves in order to allow the milled material to pass into the grooves and exert tangential forces on the cutting tool. Hereby the exposed surface area which forms the body groove portion will be sufficiently large for transferring tangential forces from material to be processed to the cutting tool. These tangential forces can cause the cutting tool to be rotated around its longitudinal axis during cutting/milling, whereby even wear is achieved.

According to some embodiments the body tip end comprising a recess for retaining at least a part of the tip within the recess. According to some embodiments the recess comprises a side wall with at least one first positioning portion, the tip base has a periphery comprising at least one second positioning portion, and that the first positioning portion of the recess side wall is arranged to abut the at least one second positioning portion of the tip base. In some embodiments the at least one first positioning portion and the at least one second positioning portion are flat. The at least one first positioning portion and the at least one second positioning portion can have any shape which prevent relative rotation between the tip base and the recess around the longitudinal axis, such as flat, convex and/or concave shape. With the positioning portions relative rotation is prevented. It is thus ensured that the tip groove portions and the body groove portions are aligned during manufacturing thus securing the smooth transition from the tip grooves to the body grooves. The positioning portions preventing relative rotation between the tip base and the recess will also make the attachment of the tip to the body stronger.

According to some embodiments the recess has a bottom with an elevated portion, the tip base comprises a depression, and the elevated portion of the recess extends into the depression of the tip base. The material which the tip is made of is often relatively expensive. With the depression in the tip base less material for the tip is needed and the cutting tool can be produced more economically efficient. The elevated portion will provide the tip with a relatively tough support which can decrease the risk of failure if the tool is hitting a stone or the like. Further, with a recess with an elevated portion and a depression in the tip base the contact surface between the parts will be larger. This provides for better attachment, e.g. when the parts are brazed or soldered together.

According to some embodiments the elevated portion comprises at least one rim, protruding towards the tip base. When the tip and the body shall be attached to each other, brazing or solder material can be poured into a small "bowl" formed by the at least one rim. The rim decrease a risk that brazing or solder material will not be distributed to the intended contact surfaces wherefore manufacturing is facilitated. The rim may also be referred to as a circumferential rim.

According to some embodiments the body radius does not exceeds 4 times, preferably not 3 times, a radius of the cylindrical portion of the tip. The cutting tool can thus be relatively "slender", which enables it to be worn down in a foreseeable and relatively controlled manner. Hereby cutting forces and vibrations are kept low, noise is reduced and a good economy is achieved to low fuel consumption and long life-time of the cutting tool.

According to some embodiments the tip is made of a hard material with a hardness of at least 1100 HV30 and the body is made of alloy steel with a hardness of at least 400 HV30. In some embodiments the alloy steel has a hardness of at least 42 HRC. A tip with a hardness of at least 1100 HV30 and a body made of alloy steel with a hardness of at least 400 HV30 has proven to work exceptionally well during milling operations.

According to some embodiments the tip is made of a hard material with a hardness of at least 1200 HV30 and the body is made of alloy steel or tool steel with a hardness of at least 480 HV30. In some embodiments the alloy steel or tool steel has a hardness of at least 48 HRC. A tip with a hardness of at least 1200 HV30 and a body made of alloy steel or tool steel with a hardness of at least 480 HV30 has proven to work exceptionally well during milling operations.

According to some embodiments the tip comprises an uneven number of grooves, such as 3, 5, 7, 9 or 11 grooves. With an uneven number of grooves forces from the material will normally be different on different sides of the cutting tool. This improves the chance of a start of rotation of the cutting tool and uneven wear which can shorten the service life of the tool is avoided.

The cutting tool may e.g. be used for coal mining, mechanical processing of rocks, in a rotary drill bit, or for working, such as milling, of asphalt, concrete or like material.

BRIEF DESCRIPTION OF THE DRAWINGS

The various aspects of embodiments herein, including its particular features and advantages, will be readily understood from the following detailed description and the accompanying drawings, in which.

DETAILED DESCRIPTION

Embodiments herein will now be described more fully with reference to the accompanying drawings. Like numbers refer to like elements throughout. Well-known functions or constructions will not necessarily be described in detail for brevity and/or clarity.

Figure 1:
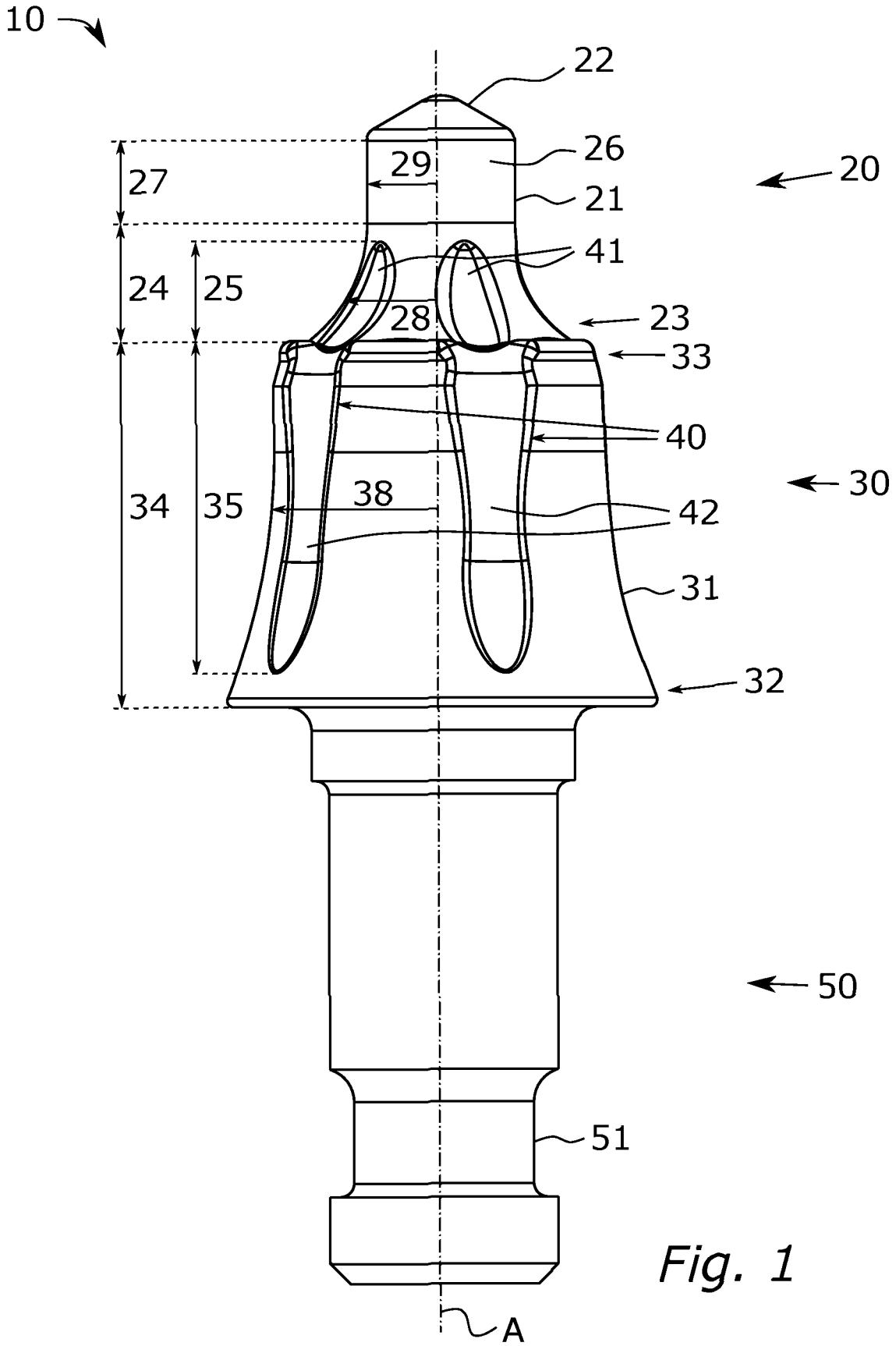
FIG. 1 illustrates a side view of a cutting tool according to some embodiments.

FIG. 1 illustrates a cutting tool 10 from a side view. The cutting tool 10 comprises a tip 20, a body 30 and a shank 50 for attaching the cutting tool 10 to a tool holder of a drill bit or a machine, such as e.g. a cutting or milling machine.

The shank 50 can be attached e.g. to a complementary shaped attachment portion of a tool holder of a rotatable drum or the like. The shank 50 can comprise one or more notches, flanges 51, protrusions or similar which may be used for securely attaching the shank 50 to a tool holder of any kind, such as the aforementioned rotatable drum. In some embodiments the shank 50 is arranged to be attached to a sleeve or collar which in turn is attached to the tool holder. The shank 50 can be attached to the tool holder in a fixed or rotatable manner. The body 30 and the shank 50 can be integrally formed or may in some embodiments be separately formed and then attached to each other.

As illustrated in FIG. 1 the body 30 comprises an outer body surface 31, a body shank end 32 arranged towards the shank 50 and a body tip end 33 arranged towards the tip 20. The tip 20 comprises an outer tip surface 21, a tip peak 22 and a tip base 23. The tip base 23 is attached to the body tip 33 end of the body 30. Hence, the tip 20 is formed as a separate part which is attached to the body tip 33 of the body 30.

Figure 2:
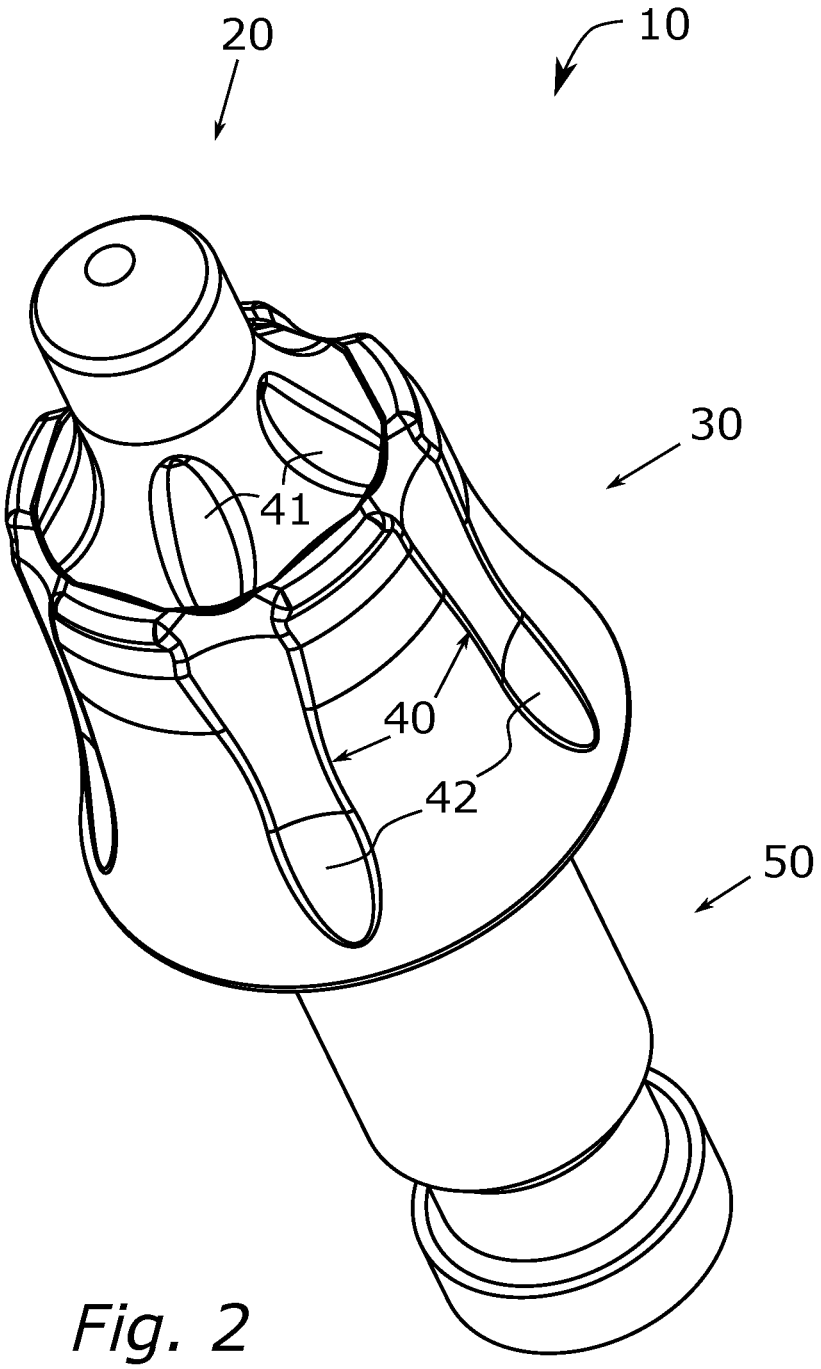
FIG. 2 is a perspective side view of the cutting tool in FIG. 1.

The cutting tool 10 comprises a plurality of grooves 40. The grooves 40 extend substantially continuously over both the outer tip surface 21 and the outer body surface 31. The extension of the grooves is also illustrated in FIG. 2. Each groove 40 has a predetermined extension in a longitudinal direction of the cutting tool. The longitudinal direction extends in the direction of longitudinal axis A, as illustrated. The longitudinal axis A may also be referred to as a centre-axis or rotation axis. For example, 3-9 grooves 40 are arranged on the outer tip surface 21 and the outer body surface 31. In some embodiments the cutting tool 10 comprises an uneven number of grooves 40.

As mentioned above, the cutting tool 10 can be used for cutting, milling and/or other treatment of a material or a surface thereof. For example, the cutting tool 10 can be used for cutting/milling asphalt, concrete or the like. When the shank 50 is attached to a tool holder or drum of any type and in contact with a material to be cut, milled or similar, some of the material will be in contact with surfaces of the grooves 40. When the cutting tool 10 is attached to the tool holder in a rotatable manner, i.e. the cutting tool is allowed to be rotated around the longitudinal axis A, material which comes into contact with the grooves 40 will cause rotation of the cutting tool 10. Due to such rotation, different parts or circumferential sections of the outer body surface 31 and the outer tip surface 21 will come into contact with the material to be cut/milled over time. Hereby even wear of the cutting tool is achieved around its periphery and articulated non-symmetric wear is avoided.

In the embodiment illustrated in FIG. 1 the tip base 23 has a tip base length 24 in the longitudinal direction. A tip groove portion 41 of the grooves 40 extend on the outer tip surface 21 over a major part 25 of the tip base length 24. The tip groove portion 41 can extend over more than 50%, 60%, 70% or 80% of the tip base length 24.

In the embodiment illustrated in FIG. 1 the body 30 has a body length 34 in the longitudinal direction. A body groove portion 42 of the grooves 40 extends on the outer body surface 31 over a major part 35 of the body length 34. The body groove portion 42 can extend over more than 50%, 60%, 70% or 80% of the body length 34.

In the embodiment illustrated in FIG. 1 the tip groove portions 41 are aligned with the body groove portions 42 when the tip 20 is attached to the body 30. By aligning the tip groove portions 41 with the body groove portions 42, the grooves 40 extending substantially continuously over both the outer tip surface 21 and the outer body surface 31 are created.

The tip 20 is made of a hard material, such as a carbide alloy. For example, the tip 20 is made of cemented carbide, tungsten cemented carbide, silicone carbide, cubic carbide, cermet, polycrystalline cubic boron nitride, silicone cemented diamond, diamond composite, polycrystalline diamond or any other material with a hardness of at least 1100 HV30. HV30 is hardness measured by Vickers hardness test and is commonly used for hard material-testing. Since hardness of a material can be measured by different kind of tests, it is understood that the tip 20 is made of a material with a hardness of at least 1100 HV30 or a corresponding hardness measured by other tests. The tip 20 can have a toughness of at least 11 K1c. The toughness, which may also be referred to as fracture toughness, can e.g. be measured by the Palmqvist method as described in US20110000717A1.

Preferably, the ISO standards ISO 3878:1983 (Vickers hardness test for Hard Metals) and ISO 6507:2005 (Vickers hardness test Metallic Materials) are to be used for hardness measurements. If measurements have been done according to another established method, conversion tables according to ISO 18265:2013 (Hardness conversion Metallic Materials) for metallic materials may be used. For toughness measurements the ISO standard ISO 28079:2009 (Palmqvist test for Hard Metals) is preferably used.

The body 30 is made of an alloy steel or tool steel with a hardness of at least 400 HV30 or a corresponding hardness measured by other tests. For example, 400 HV30 is substantially equal to 42 HRC. HV30 is hardness measured by Vickers hardness test and is commonly used for testing hardness of hard materials like cemented carbide, alloy steel etc. HRC is hardness measured by Rockwell hardness test and is also commonly used for testing hardness of alloy steel etc.

The body 30 can for example be made of low-alloy steel, such as of steel comprising about, in weight-percent: 1% Cr, 0.2% Mo, 0.8% Mn, 0.4% C, 0.3% Si, 0.025% P and 0.035% S. The tip 20 can for example comprise 5-7% Co and 93-95% WC, such as about 6% Co and 94% WC. The hardness depends e.g. on the Cobalt content and the particle size of the material.

The below chart 1 illustrate test result from tests where different cutting tools with different designs and properties have been tested. Column A represents a reference cutting tool according to the prior art. In Columns B, C, D and E properties for cutting tools according to different embodiments described herein are illustrated. For example "Performance Improvement 15%" indicated that the cutting tool can be used about 15% longer than the reference cutting tool A. A cost index of −18% indicated that the carbide tip cost is approximately 18% lower than for the reference cutting tool A.

The tests were made with a standard 2 m wide cold planner machine. The cutting depth was the removal depth in asphalt material. The cutting speed was the forward moving speed of the cold planner machine. The service life in practical test, m2, was the total milled area. The tip length was the length or height of the cemented carbide tip. The tip weight, g, was the weight of the cemented carbide tip which constitute the main part of the cost for the milling cutting tool.

CHART 1

| | Cutting tool | | | | |
|---|---|---|---|---|---|
| | A | B | C | D | E |
| Tip length (mm) | 20.5 | 20.5 | 20.5 | 20.5 | 20.5 |
| Cutting depth (cm) | 4.0-5.0 | 4.0-5.0 | 4.0-5.0 | 4.0-5.0 | 4.0-5.0 |
| Cutting speed (meter/min) | 16.0-19.0 | 16.0-19.0 | 16.0-19.0 | 16.0-19.0 | 16.0-19.0 |
| Service life in test, m2 | 10120 | 11600 | 11600 | 11600 | 11600 |
| Performance improvement | — | +15% | +15% | +15% | +15% |
| Tip weight (g) | 41.3 | 40.348 | 36.997 | 34.818 | 34.006 |
| Cost index (carbide tip cost) | — | −2% | −10% | −16% | −18% |

Cutting tool B has better rotation properties than A, implying more even wear and longer service life, at least for cutting of some kind of materials. Cutting tool B had a lower content of carbide than A, wherefore production cost can be lower for B than for A if other properties are equal. For some embodiments the cost for the carbide tip is 50-80% of a total cost for producing the cutting tool. Further, use of B, C, D and E led to lower fuel consumption due to a lower required driving force of the planner than for A.

As illustrated in FIG. 1, the tip can comprise a substantially cylindrically shaped portion 26 which extends with a length 27 in the longitudinal direction between the tip peak 22 and the tip base 23. In some embodiments the length 27 of the substantially cylindrically shaped portion 26 exceeds 10 mm. In some embodiments, the tip peak 22 comprises a chamfered or tapered portion. The shape of the tip peak 22 can then be seen as substantially frustoconical.

The body 30 may have a radius 38 which increases continuously along a smooth curve from the body tip end 33 to the body shank end 32. Further, tip may have a radius 28 which increases continuously along a smooth curve from the cylindrically-shaped portion 26 to a distal portion of the tip base 23, i.e. to the lower end of the tip base 23 in FIG. 1 which is attached to the body tip end 33.

The body length 34 can exceed a diameter of the body 30. A length of the tip 20 can exceed a diameter of the tip base 23. In some embodiments the body radius 38 does not exceeds 3 or 4 times a radius 29 of the tip cylindrical portion. The cutting tool 10 may therefore be referred to as a slender type of cutting tool.

FIG. 2 illustrates the cutting tool 10 from a perspective view. In FIG. 2 the tip 20, the body 30 and the shank 50 are illustrated. A major part of the cutting tool 10 can have a shape that is substantially rotational symmetric with reference to the longitudinal axis A (illustrated in FIG. 1) of the cutting tool 10.

In FIG. 2 the extensions of the substantially continuous grooves 40 with the tip groove portions 41 and the body groove portions 42 are illustrated. In the embodiment depicted in FIG. 2 the tip 20 is fitted into a recess of the body 30. The recess is further discussed in conjunction with FIGS. 4-6. As illustrated, the grooves 40 runs or extends such that a radius 28 of the tip base 23 is smaller at the tip groove portions 41 than at adjacent parts of the outer tip surface 21. Correspondingly, the grooves 40 run or extends such that a radius 38 of the body 30 is smaller at the body groove portions 42 than at adjacent parts of the outer body surface 31. In some embodiments a main direction of the tip groove portions 41 are substantially aligned with a main direction the body groove portions 42. A shape and magnitude of a cross-section of the grooves 40 may vary along the extension of the grooves 40. The cross sections of the grooves may be e.g. U-shaped, or shaped as a semi-circle. The extension of the grooves 40 can exceed 15 mm. In some embodiments the extension of the grooves 40 exceeds 20 mm and in some embodiments the extension of the grooves 40 exceeds 25 mm.

In some embodiments a depth of the tip groove portions 41 is at least 0.5 mm and in some other embodiments a depth of the tip groove portion 41 is at least 1 mm relative the radius adjacent to the groove. In some embodiments a depth of the body groove portions 42 is at least 1 mm or at least 2 mm relative the radius adjacent to the groove. In some embodiments the depth of the grooves 40 is at least half of a width of the grooves 40 over at least some parts of the longitudinal extension of the grooves 40.

Figure 3:
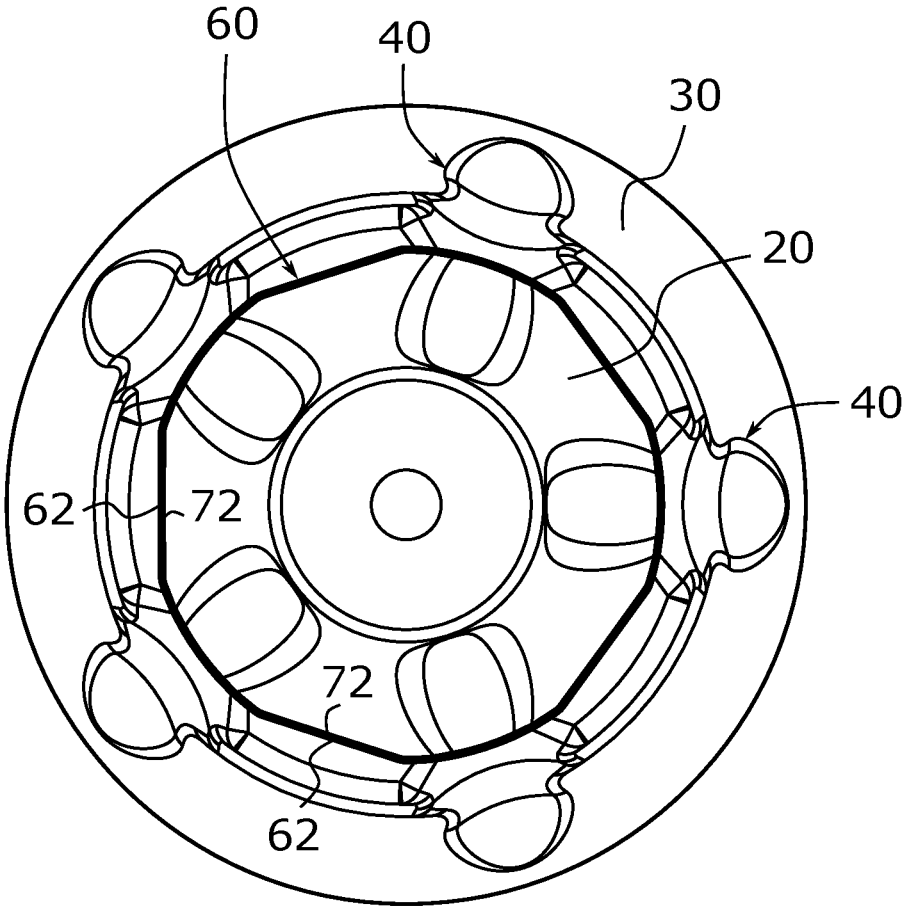
FIG. 3 is a top view of the cutting tool in FIG. 1.

FIG. 3 illustrates the cutting tool 10 with its tip 20, body 30 and grooves 40 from above. The body tip end of the body 30 comprises a recess 60 for firmly retaining at least a part of the tip 20 within the recess 60. The recess 60 is further discussed in conjunction with FIGS. 4-6.

The recess 60 comprises a side wall with at least one first positioning portion 62. The tip base has a periphery comprising at least one second positioning portion 72. The at least one first positioning portion 62 of the recess side wall is arranged to abut the at least one second positioning portion 72 of the tip base. In the embodiment illustrated in FIG. 3 the first positioning portions 62 comprises five substantially flat portions. The interface between the tip and the body may have any shape which prevents the tip 20 to rotate relatively the body 30. In other words, the interface between the tip 20 and the body 30 is configured in a non-rotation-symmetry-manner, which may also be referred to as the interface having a non-circular-cylindrical shape with a symmetry which prevents rotation of the tip 20 relative to the body 30.

Figure 4:
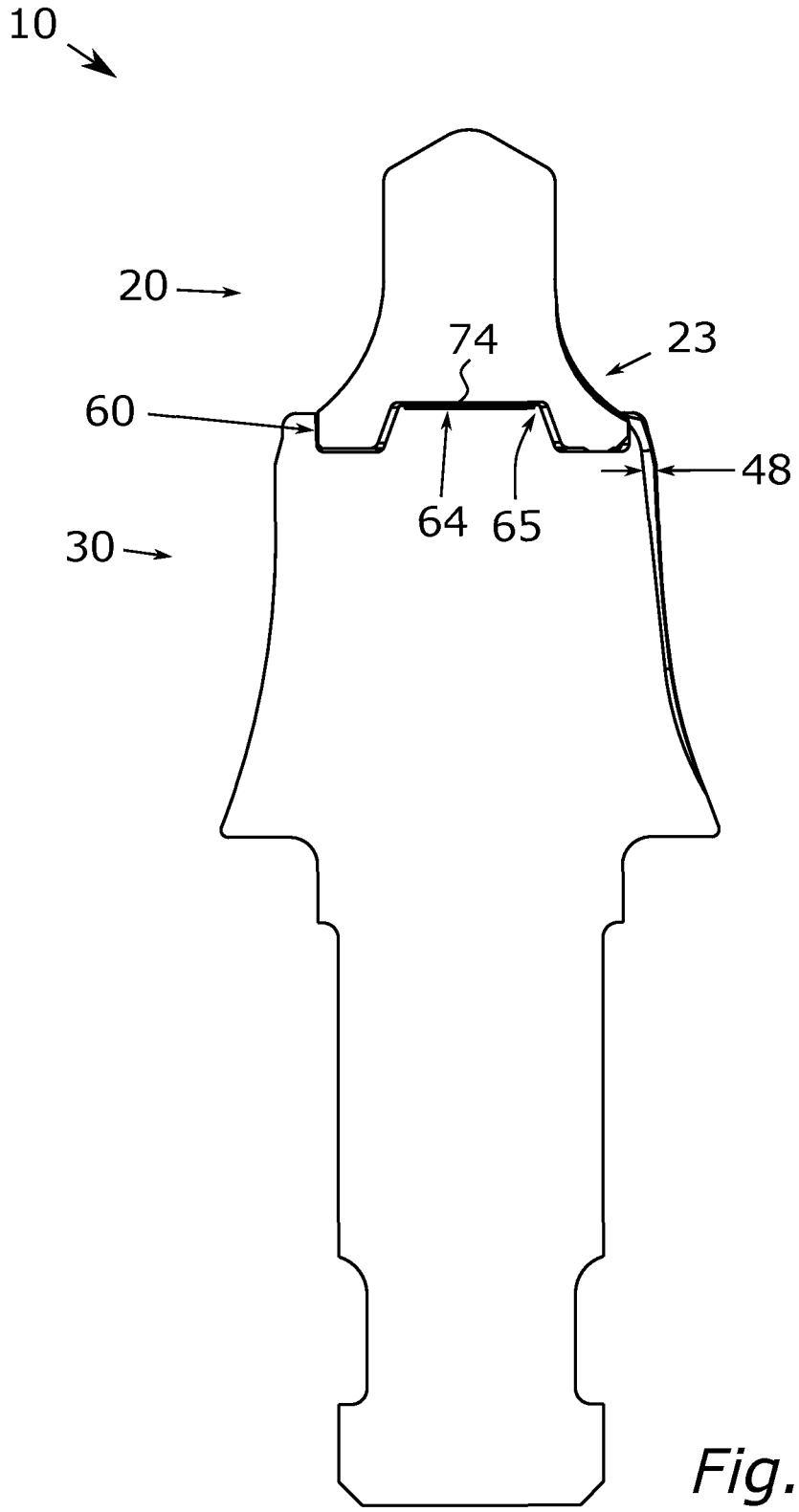
FIG. 4 is a cross sectional view of the cutting tool according to some embodiments.
Figure 5:
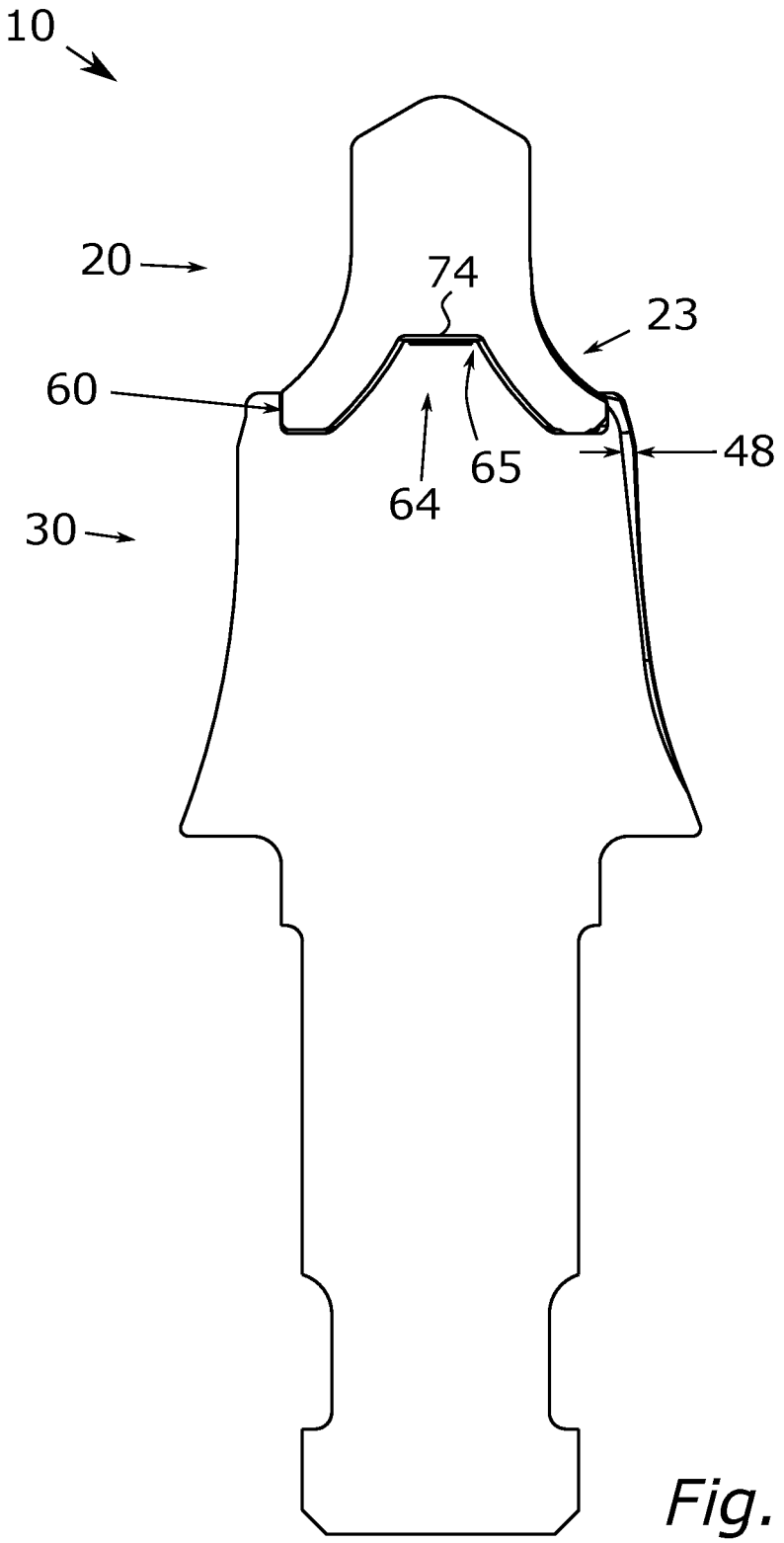
FIG. 5 is a cross sectional view of the cutting tool according to some other embodiments.
Figure 6:
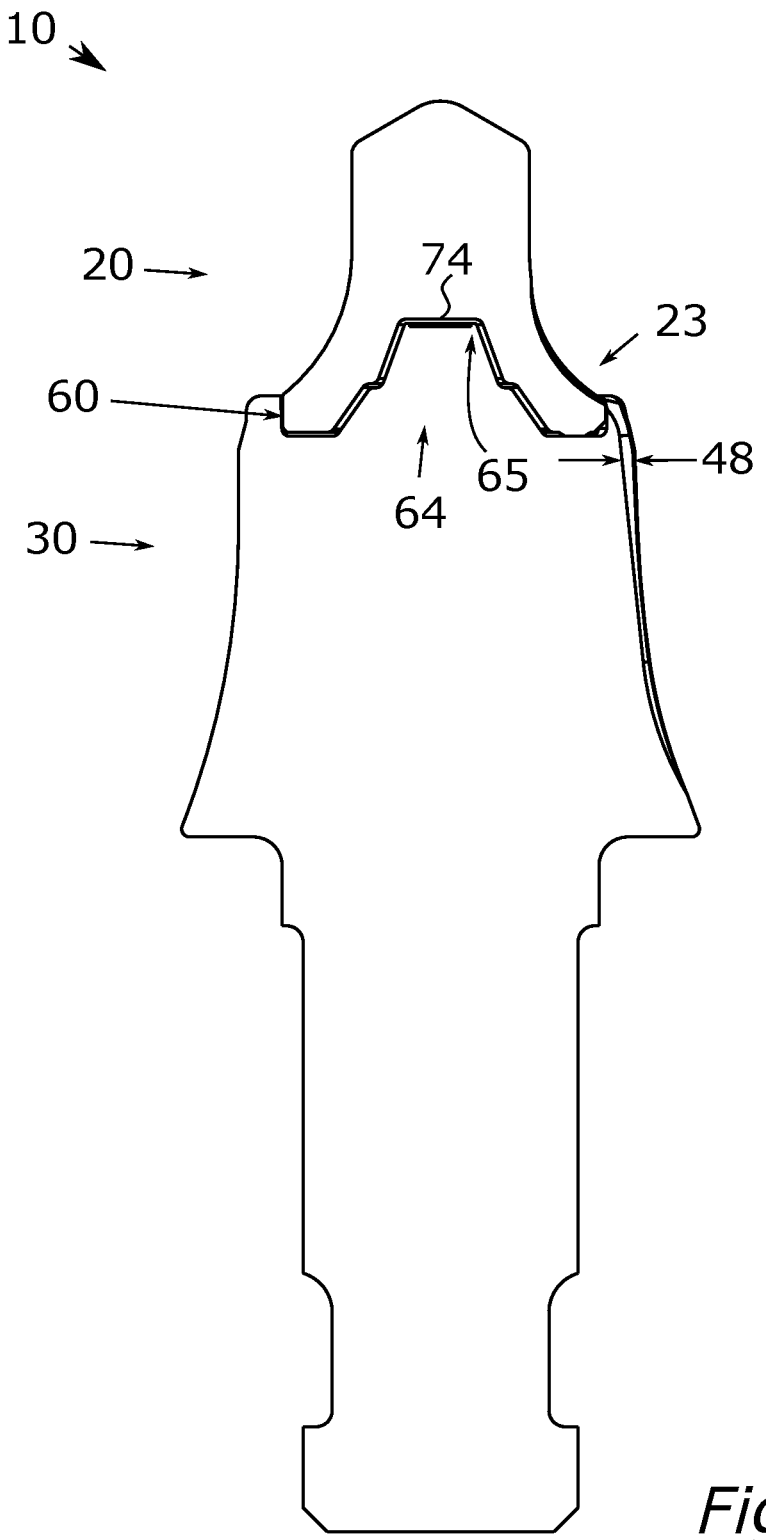
FIG. 6 is a cross sectional view of the cutting tool according to yet some other embodiments.

In FIG. 4, FIG. 5 and FIG. 6 cross-sections of the tip 20 with its tip base 23, the body 30 and the recess 60 are illustrated.

In the embodiment depicted in FIG. 4 the recess 60 has a bottom with an elevated portion 64. The tip base 23 comprises a depression 74. The elevated portion 64 of the recess 60 extends into the depression 74 of the tip base 23. Solder or braze material can be arranged in the recess for firm attachment of the tip 20 to the body e.g. via soldering or brazing. The tip may be attached by other means, for example via press-fitting. The recess 60 and the tip base may be substantially complementary shaped, such that a tight and firm connection is achieved.

In some embodiments the elevated portion 64 comprises at least one rim 65, protruding towards the tip base 23. Some embodiments may comprise more than one rim, such as two or three rims. Hereby solder material can be safely retained during an assembly operation. In some embodiments the bottom of the recess is substantially flat.

In FIGS. 4-6 also the depth 48 of a body groove portion is depicted in the respective cross-sectional view.

As used herein, the term "comprising" or "comprises" is open-ended, and includes one or more stated features, elements, steps, components or functions but does not preclude the presence or addition of one or more other features, elements, steps, components, functions or groups thereof.

The invention claimed is:

1. A cutting tool comprising a tip, a body and a shank for attaching the cutting tool to a tool holder, the body having an outer body surface, a body shank end arranged towards the shank and a body tip end arranged towards the tip, the tip having an outer tip surface, a tip peak and a tip base, the tip base being attached to the body tip end of the body, characterized in that the body tip end comprises a recess for retaining at least a part of the tip within the recess, and that the cutting tool comprises a plurality of grooves extending substantially continuously over both the outer tip surface and the outer body surface, each groove having a predetermined extension aligned with a longitudinal direction of the cutting tool, wherein a body groove portion of each of the plurality of grooves extends on the outer body surface over part of a body length, the body groove portion extending over a major part of the body length, which major part is less than the full body length.

2. The cutting tool according to claim 1, wherein the tip base has a tip base length in the longitudinal direction, and where a tip groove portion of each of the plurality of grooves extends on the outer tip surface over a major part of the tip base length.

3. The cutting tool according to claim 1, wherein the tip comprises a substantially cylindrically-shaped portion which extends in the longitudinal direction between the tip peak and the tip base, and that a length of the substantially cylindrically shaped portion exceeds 10 mm.

4. The cutting tool according to claim 3, wherein the tip has a radius which increases continuously along a smooth curve from the cylindrically-shaped portion to a distal portion of the tip base.

5. The cutting tool according to claim 3, wherein a depth of a tip groove portion of each of the plurality of grooves is at least 0.5 mm.

6. The cutting tool according to claim 3, wherein a depth of a body groove portion of each of the plurality of grooves is at least 1 mm.

7. The cutting tool according to claim 3, wherein a body radius does not exceeds 4 times a radius of the cylindrically shaped portion of the tip.

8. The cutting tool according to claim 3, wherein the tip is made of a hard material with a hardness of at least 1100 HV30 and the body is made of alloy steel or tool steel with a hardness of at least 400 HV30.

9. The cutting tool according to claim 3, wherein the tip comprises an uneven number of grooves.

10. The cutting tool according to claim 1, wherein the body has a radius which increases continuously along a smooth curve from the body tip end to the body shank end.

11. The cutting tool according to claim 1, wherein the recess comprises a side wall with at least one first positioning portion, the tip base has a periphery comprising at least one second positioning portion, and that the at least one first positioning portion of the recess side wall is arranged to abut the at least one second positioning portion of the tip base.

12. The cutting tool according to claim 1, wherein the recess has a bottom with an elevated portion, the tip base comprises a depression, and where the elevated portion of the recess extends into the depression of the tip base.

13. The cutting tool according to claim 12, wherein the elevated portion comprises at least one rim protruding towards the tip base.

* * * * *